United States Patent [19]

Andersen et al.

[11] 4,204,460

[45] May 27, 1980

[54] ARRANGEMENT FOR INFLUENCING THE OPERATING QUANTITY OF A SERVO-MOTOR

[75] Inventors: Hans S. Andersen, Augustenborg; Preben Christiansen, Nordborg, both of Denmark

[73] Assignee: Danfoss A/S, Nordborg, Denmark

[21] Appl. No.: 883,287

[22] Filed: Mar. 3, 1978

Related U.S. Application Data

[62] Division of Ser. No. 758,613, Jan. 12, 1977, abandoned.

[30] Foreign Application Priority Data

Jan. 21, 1976 [DE] Fed. Rep. of Germany ..... 2601999

[51] Int. Cl.[2] ..... F15B 11/08; F15B 13/042

[52] U.S. Cl. ..... 91/447; 91/448; 137/596.12

[58] Field of Search ..... 91/447, 448, 469; 137/596, 596.12

[56] References Cited

U.S. PATENT DOCUMENTS

| | | | |
|---|---|---|---|
| 3,067,725 | 12/1962 | Hemstreet et al. | 91/447 |
| 3,559,534 | 2/1971 | Munro | 91/447 X |
| 3,566,749 | 3/1971 | Allen et al. | 91/447 X |

FOREIGN PATENT DOCUMENTS

| | | | |
|---|---|---|---|
| 1817822 | 1/1972 | Fed. Rep. of Germany | 91/447 |

*Primary Examiner*—Irwin C. Cohen
*Attorney, Agent, or Firm*—Wayne B. Easton

[57] ABSTRACT

The invention relates to a fluid pressure supply system for controlling a servomotor and in particular the forward speed of the servomotor, such as the raising speed of a fork lift truck, independently of the actual loading on the servomotor. This is accomplished with the combination of a pressure responsive regulating and reducing valve and a throttle valve in the supply branch of the circuit. The pressure regulating and reducing valves have setting elements that are loaded in opening directions by desired value springs and by a pilot pressure tapped between the reducing valve and the throttle valve.

1 Claim, 4 Drawing Figures

Fig.1
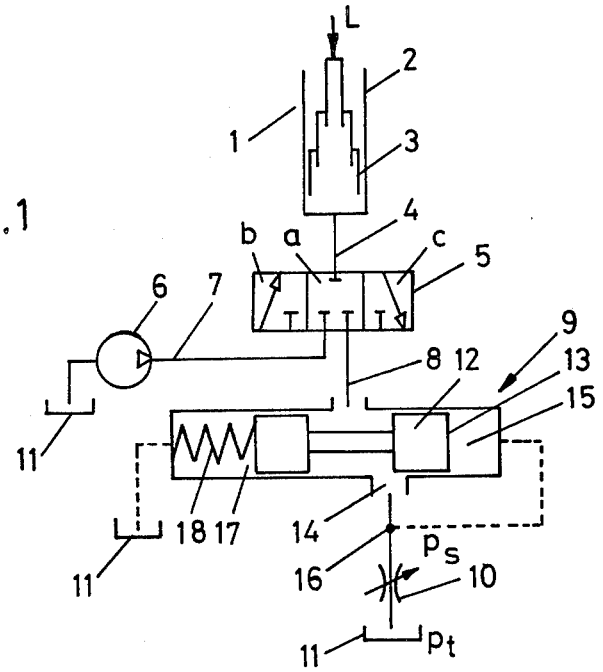
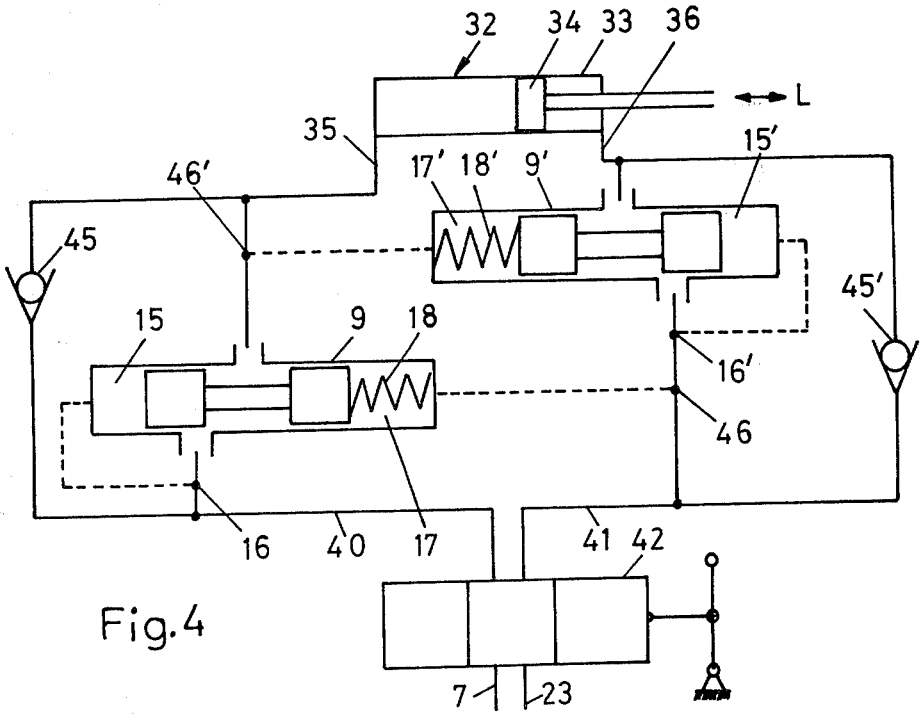
Fig.4

ARRANGEMENT FOR INFLUENCING THE OPERATING QUANTITY OF A SERVO-MOTOR

This application is a Divisional Application of Ser. No. 758,613 filed Jan. 12, 1977, and now abandoned.

The invention relates to an arrangement for influencing the operating quantity of a servo-motor that is loadable by an external force, comprising a pressure responsive reducing valve in the return conduit, of which the setting element is loaded in the first direction by a desired value spring and in the other direction by a pilot pressure existing in a first pressure chamber.

In a known arrangement, the two connecting conduits for the servo-motor are connected to the pump and the tank by a four-way switching valve which, apart from the neutral position, has one position for right-hand operation and one position for left-hand operation. In both motor connecting conduits there is a breaking valve which functions only one return flow operation because it is bridged by a check valve that is open towards the servo motor. The pressure in the respective other motor connecting conduit, i.e. the supply conduit, serves as pilot pressure for the braking valve. The braking valve is loaded in the closing direction by the desired value spring and opens under the influence of the pressure in the supply conduit. If, now, an external load acts on the servo-motor, e.g. the weight of a load in the case of lifting tackle, the force of the flow of water in the case of a control rudder, or the like, which tends to move the servo-motor more rapidly than the speed corresponding to the arriving pressure fluid, the pressure in the supply conduit drops and the braking valve is moved in the closing direction. However, this pressure in the supply conduit does not give a correct signal, particularly in the case of loading the servo-motor by an external force (negative load). In addition, the throttling that is effected thereby affects the said pressure only with a large time constant. Further, the speed of the servo-motor cannot be controlled in this manner. Still further, the load cannot be decreased when there is no pump pressure.

To control a servo-motor, it is known to include an adjustable throttle element in the supply conduit of a servo-motor. A defined throughflow quantity can be associated with the setting path of the throttle element if the throttle element is preceded by a regulating valve which keeps the pressure drop at the throttle element constant.

The invention is based on the problem of providing an arrangement of the aforementioned kind with which the throughflow quantity of a servo-motor can be adjusted at will independently of the load of an external force (negative load).

This problem is solved according to the invention in that an adjustable first throttle element is disposed in the return conduit behind the reducing valve and that the pilot pressure is derived from between the reducing valve and the first throttle element.

The reducing valve seeks to keep the pressure constant at a value predetermined by the desired value spring. The quantity flow through the throttle element is therefore a clear function of the orifice cross-section or the setting path of the first throttle element. In this way one can, for example, control the lowering speed of a fork lift truck, lift or the like independently of the actual loading. In this connection it is immaterial whether the servo-motor has a single-acting or double-acting cylinder.

The operating conditions are altered only very little if, in addition to the desired value spring, still other forces act on the setting element of the reducing valve, particularly if they are only small or likewise constant.

In an arrangement for a servo-motor having a supply and an outlet, this fact is advantageously utilised in that in the supply conduit that is fed from the pump there is an adjustable second throttle element coupled to the first throttle element, and that the setting element of the reducing valve is additionally, in the same sense as the desired value spring, loaded by the pressure existing in a second pressure chamber between the second throttle element and the servo-motor. During normal operation, the reducing valve is thereby brought to the open position because the pressure in the supply conduit is considerably higher than that between the reducing valve and the first throttle element. If, however, an external load acts on the servo-motor in the operating direction, and the pressure in the supply conduit thereby drops, the reducing valve goes over to a throttling position which prevents excessively rapid outflow of the return flow quantity. If dangerously low pressures that could give rise to cavitation occur on the supply side, the desired valve spring practically functions alone, so that the above-described conditions arise in the return conduit. During normal operation, therefore, the control of the operating quantity is effected by the second throttle element and with a negative load by the first throttle element, switching over taking place automatically.

It is of particular advantage if a regulating valve is connected in series with the second throttle element for holding the pressure drop at the second throttle element constant. In this way the orifice cross-section or the setting path is likewise a clear indication for the throughflow quantity in the case of the second throttle element.

Desirably, the reducing valve is designed so that the pressure drop influenced by it at the first throttle element is at most equal to the pressure drop at the second throttle element as determined by the regulating valve. With such dimensioning, it is ensured that the pressure between the first throttle element and the servo-motor will never drop below the tank pressure, i.e. cavitation phenomena are avoided in every case.

It is also favorable if a check valve openable towards the servo-motor is in parallel with the reducing valve. In this way, the reducing valve will be inoperative when the motor connecting conduit is used as a supply conduit instead of a return conduit.

A similar effect is achieved if the conduit with the reducing valve is usable as a return conduit in a first operative position of a switch element and as a supply conduit in a second operative position of the switch element and if in at least the second operative position the second pressure chamber is fed with the pressure between the second throttle element and the servo-motor. In this way the same pressure will exist during supply operation in both pressure chambers and the reducing valve will be open under the influence of the desired value spring.

If a negative load can act in both directions of movement of the motor, e.g. in the case of a control rudder, a reducing valve may also be provided in each of the two motor connecting conduits.

Both throttle elements preferably always assume substantially the same orifice cross-section. This results in clear conditions and also permits an exchange of the first and second throttle elements during reverse operation.

In particular, the first and second throttle elements can be combined as a four-way valve with intermediate throttling positions. With such a valve, synchronism of the orifice cross-sections is ensured in a simple manner.

Further, the four-way valve may serve as first switch element and possess further switching paths forming the second switch element.

Further, it is advisable to provide the motor connection on the return flow side with a safety valve. This safety valve lowers pressure peaks and therefore not only protects the conduit system but also the series circuit of the reducing valve and the first throttle element.

The invention will now be described in more detail with reference to the examples shown in the drawings, wherein:

FIG. 1 is a simplified circuit for a single-acting servo-motor;

FIG. 4 shows a modified part of FIG. 3 with a double-acting servo-motor in which the negative load can have an influence in both directions.

Figure 2:
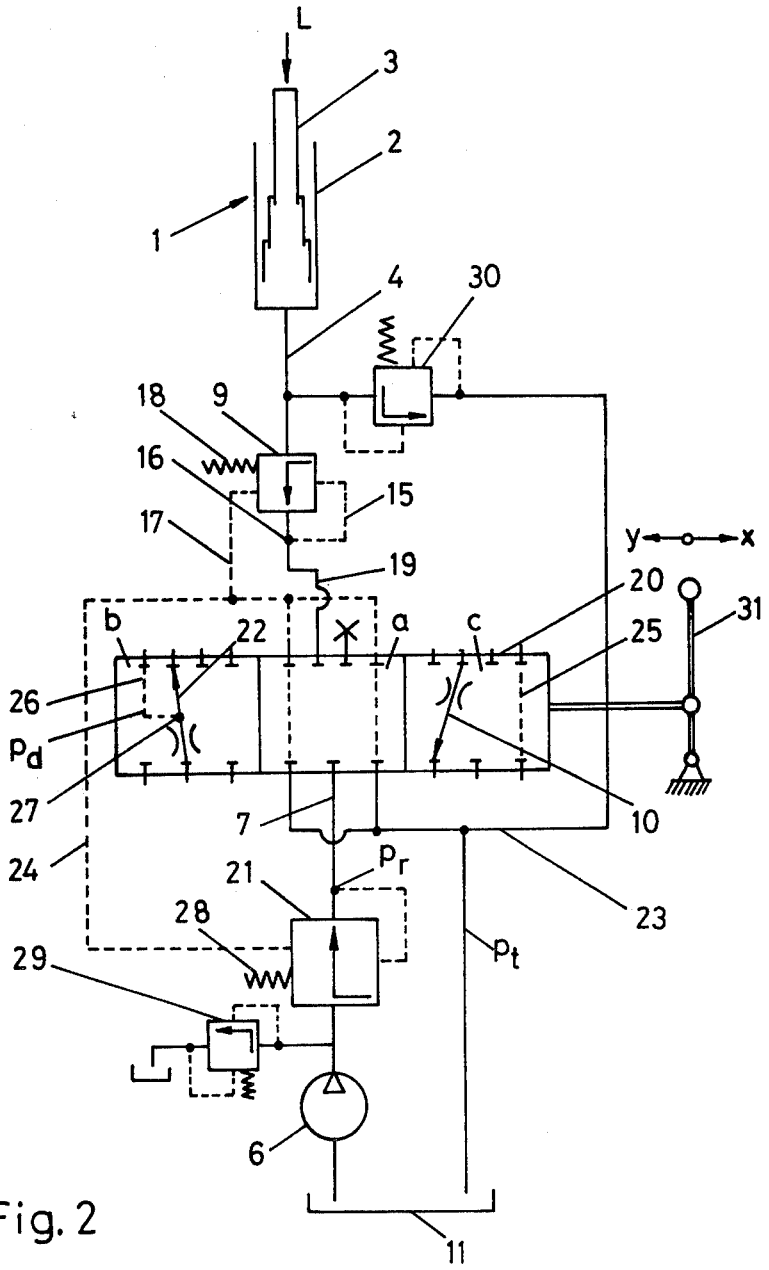
FIG. 2 is a more complete circuit for a single-acting servo-motor.

FIG. 1 illustrates a single-acting servo-motor 1 with cylinder 2 and telescopic piston 3 of which the connecting conduit 4 can, with the aid of a three-way switching valve 5, be selectively closed (rest position a), connected to a supply conduit 7 fed by a pump 6 (operative position b) or connected to a return conduit 8 (operative position c). In the return conduit 8 there is a reducing valve 9 and behind that an adjustable throttle element 10 from which fluid flows directly to the tank 11.

The reducing valve possesses a setting element 12 of which the piston 13 controls a valve orifice 14. A first pressure chamber 15 is connected to a point 16 between the reducing valve 9 and the throttle element 10. A second pressure chamber 17 is connected to the tank 11 and contains a preferably adjustable desired value spring 18.

When the switching valve 5 moves to its operative position b, the piston 3 of the servo-motor 1 is lifted against a load L by the pressure fluid delivered by the pump 6. This displacement can, for example, be controlled by means of a regulatable pump drive. The load L can assume different values, e.g. in a fork lift truck that has to transport different goods. When the switching valve 5 is brought to the other operative position c, pressure fluid flows in from the servo-motor under the influence of the load L through the return conduit 8 to the tank 11. The reducing valve 9 that was fully open in the rest condition under the influence of the desired value spring 18 is now subjected to the pressure $p_s$ at the point 16 and displaced in the closing direction until a pressure as determined by the desired value spring 18 obtains at the point 16. Since the tank pressure $p_t$ is constant, a constant pressure drop $p_s - p_t$ also occurs at the throttle element. Since these conditions are also substantially maintained on a change in the throttle setting and independently of a change in the load L, the return flow quantity is practically exclusively governed by the set orifice cross-section of the throttle element 10. By adjusting the throttle element, the lowering movement can therefore be controlled.

In the embodiment according to FIG. 2, the same reference numerals as in FIG. 1 are used for similar components. The motor connecting conduit 4 is connected by way of the reducing valve 9 to a connection 19 of a switching valve 20 and can be selectively connected to the pump 6 by way of a pressure regulating valve 21 and a throttle path 22 or to a tank conduit 23 by way of a throttle path serving as first throttle element 10. The pressure chamber 17 is connected to a conduit 24 which, in the illustrated rest position a and in the operative position c associated with return flow, is likewise connected to the tank conduit 23 by way of passages 25 but, in the operative position b associated with forward flow, is connected to a point 27 behind the adjustable supply throttle by way of a switching path 26. The pressure in the conduit 24 is in addition supplied to the pressure regulating valve 21 in the same sense as the force of a spring 28 whereas in the opposite direction a pressure $P_r$ acts between the regulating valve 21 and the switching valve 20. Further, a safety valve 29 which opens in the usual manner when a predetermined pump pressure is exceeded is connected to the output of the pump 6. A similar safety valve 30 leads from the motor connecting conduit 4 to the tank conduit 23.

The following manner of operation applies to this arrangement. When the switching valve 20 is moved by means of the handle 21 through a predetermined setting path x in to the operative position b, fluid flows from the pump 6 through the regulating valve 21, the throttling path 22 and the reducing valve 9 to the servo-motor 1. In the conduit 24, and therefore also in the pressure chamber 17, there is a pressure $p_d$ which also exists in the pressure chamber 15. The reducing valve 9 therefore opens operatively under the influence of the desired value spring 18. The regulating valve 21 is under the influence of the pressure drop at the switching valve 20 and holds this constant. Consequently, the supply quantity and therefore the displacement speed of the servo-motor 1 is determined solely by the orifice cross-section of the throttling path 22, irrespective of the size of the load L. Desirably, the regulating valve 21 is designed so that it leads excessive pressure fluid directly to the tank.

If the switching valve 20 is displaced by means of the handle 31 by a predetermined setting path y to the operative position c, then pressure fluid flows from the servo-motor 1 through the reducing valve 9 and the first throttle element 10 to the tank 11. The tank pressure $p_t$ exists in the pressure chamber 17 and the pressure $p_s$ exists in the pressure chamber 15. The same conditions therefore obtain as those described in connection with FIG. 1.

Figure 3:
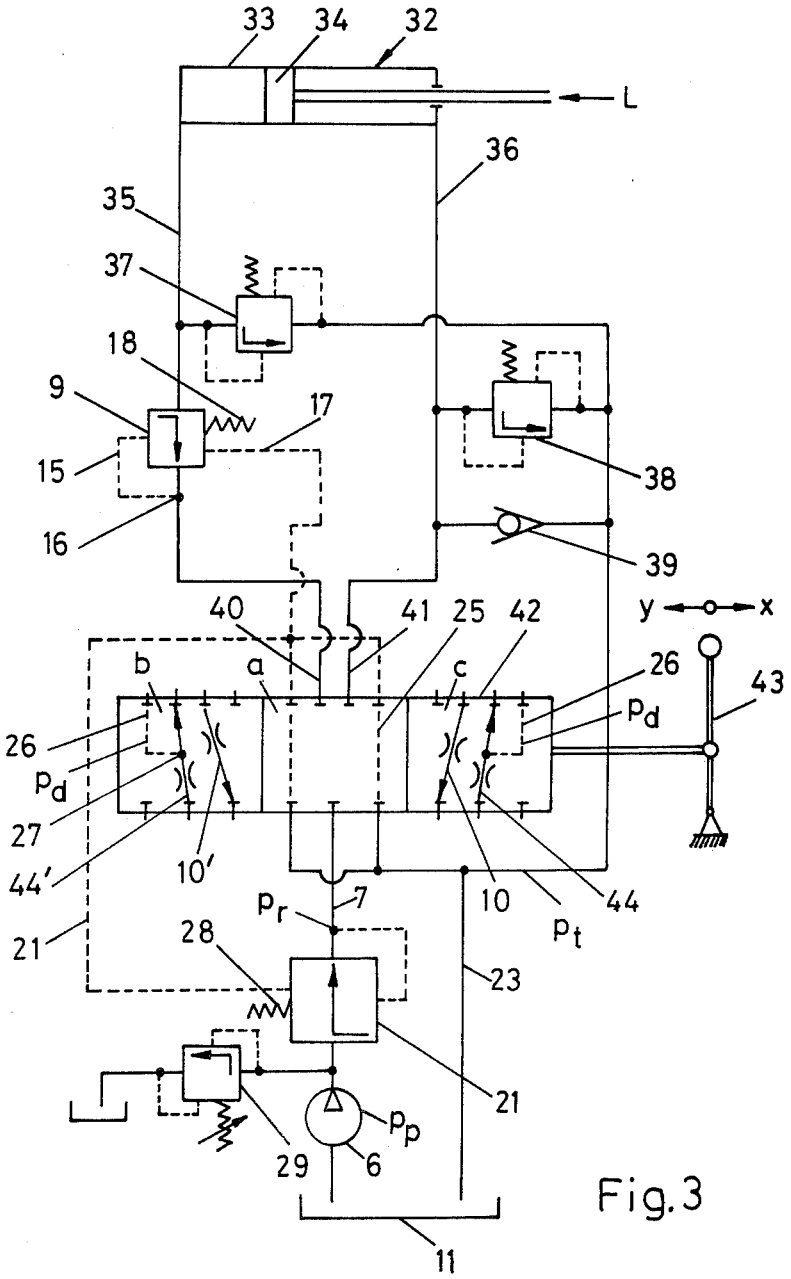
FIG. 3 is a circuit for a double-acting servo-motor in which the negative load can have an influence only in one direction.

In the embodiment according to FIG. 3, a servo-motor 32 is provided which comprises a cylinder 33 and a piston 34 that can be loaded by an external load L. Accordingly, two motor connecting conduits 35 and 36 are also provided which communicate with the tank conduit 23 through a safety valve 37 and 38. For the purpose of replenishment, the connecting conduit 36 is connected to the tank conduit 23 by a check valve 39. The connecting conduit 35 communicates with a connection 40 through the reducing valve 9 and the connecting conduit 36 communicates directly with a connection 41 of a four-way switching valve 42 which is adjustable by a handle 43. For each operating direction there is a first throttle element 10 or 10' for the return flow and a second throttle element 44 or 44' for the forward flow. No throttle elements are adjustable in unison. For the operative position b (setting path x) and the operative position c (setting path y) they have the same orifice cross-section in pairs. In other particulars, the circuit corresponds to FIG. 2.

The manner of operation is in this case as follows. When the switching valve 42 is displaced through a setting path x into the operative position b, pressure fluid flows from the pump 6 through the regulating valve 21, the second throttle element 44' and the reducing valve 9 to the left-hand side of the servo-motor 32. At the same time,, pressure medium flows through the first throttle element 10' to the tank. The pressure $p_d$ is applied to the conduit 17 through the switching path 26. Accordingly, the reducing valve 9 is opened fully by the desired value spring 18. The regulating valve 21 holds the pressure drop at the switching valve 42 constant. The arriving quantity is therefore determined by the setting path x and the corresponding throttle orifice in the throttle element 44'.

If the switching valve 42 is displaced to the operative position c through a setting path y, arriving pressure fluid flows through the throttle element 44 direct to the right-hand side of the servo-motor 32. Simultaneously, the pressure chamber 17 of the reducing valve 9 is again supplied with the pressure $p_d$, whilst the pressure $p_s$ at the point 16 is regulated by the reducing valve 9. The returning quantity of pressure fluid flows through the now regulated reducing valve 9 and then through the settable throttle element 10. When no negative load L is present, the pressure $p_d$ in the pressure chamber 17 is considerably higher than the pressure $p_s$ in the pressure chamber 15, so that the reducing valve 9 is completely open and the control of the operating quantity is affected solely by the throttle element 44. If, however, the negative load L becomes larger, the pressure $p_d$ drops until the pressure $p_s$ finally becomes so large that the reducing valve 9 is moved in the closing direction. This results in throttling of the quantity of return flow, so that the control operation for the supply conduit can still be maintained. If, however, the pressure in the connecting conduit 36 becomes so low by reason of the negative load L that control on the supply side is no longer possible, the pressure in the pressure chamber 17 is likewise so low that the pressure $p_s$ can be kept constant by the reducing valve 9 and the control of the throughflow quantity is now effected by the throttle element 10.

The following numerical example will make the manner of operation still clearer. It is assumed that the pressure drop over the throttle element 44 or 44' is kept constant at 4 bar by means of the regulating valve 21, that the load L=200 bar, that the cross-section of the cylinder on the left-hand side is twice that on the right-hand side, that the desired value spring 18 exerts a pressure of 3 bar, and that the throttle elements 10, 44 or 10', 44' have the same orifice in pairs. Further, the setting is to be such that 5 liters flow through the throttle element 44'.

(a) If the switching valve 42 is displaced to the operative position b, the pressure drop at the throttle element 10 can be calculated to be 1 bar. When the tank pressure is 0 bar, the pressure $p_s$ is 201 bar and the pump pressure 204 bar.

(b) If the switching valve 42 is displaced to the operative position c, the pressure drop at the throttle element 10 can be calculated to be 16 bar. Since this pressure is equal to the pressure $p_d$ in the supply conduit plus a constant pressure emanating from the spring 18, this pressure $p_d$ amounts to 13 bar and consequently the pump pressure $p_p$ amounts to 17 bar.

In the embodiment according to FIG. 4 only the part of the circuit disposed beyond the switching valve 42 is illustrated. This time both connecting conduits 35 and 36 are connected to the associated connections 40 and 41 by way of a respective reducing valve 9 or 9'. Both are bridged by a check valve 45, 45' that opens toward the motor 32. The pressure chamber 15 communicates with the point 16 and the pressure chamber 15' with the point 16'. The pressure chamber 17 communicates with a point 46 at the connection 41 or at the connecting conduit 36 and the pressure chamber 17' communicates with a point 46 at the connection 40 or at the connecting conduit 35.

When the connection 41 transmits supply pressure, the servo-motor 32 is fed by way of the check valve 45'. The reducing valve 9 goes over the open position so that the pressure fluid can flow off without hindrance. Only when the load L is too large and the pressure in the connection 41 drops will the reducing valve have a throttling effect in the described manner. The same also applies to adjustment of the motor 32 in the reverse direction with a correspondingly reversely acting external load.

Instead of the check valves 45, 45' one can also use reducing valves 9, 9' controlled in the nature of the reducing valve 9 of FIG. 3 by way of the switching valve 42.

We claim:

1. A servomotor assembly comprising, a servomotor having a single inlet and outlet port and being loadable by an external force, pump means and tank means, reducing valve means connected to said servomotor port, said reducing valve means having pressure responsive setting means and desired valve spring means biasing said reducing valve means in an opening direction, said reducing valve means having first and second pressure chambers with pressure therein respectively opposing and assisting said spring means relative to said setting means, a pressure regulating valve connected to said pump means and having second desired valve spring means biasing said pressure regulating valve in a closing direction, said pressure regulating valve having first and second pressure responsive portions with pressures acting thereon respectively opposing and assisting said second desired valve spring means, switching valve means between said reducing valve means on the one hand and said pressure regulating valve and said tank on the other hand, said switching valve means having first and second throttles, said switching valve means being operable to retract said load by placing said first throttle in series with said reducing valve means and connecting said reducing valve second chamber to said tank, said switching valve means being alternately operable to advance said load by placing said second throttle in series with said reducing valve means and said pressure regulating valve and connecting said second chambers of both said reducing valve means and said pressure regulating valve to the output of said second throttle valve, said reducing valve first chamber being connected to a circuit point between said reducing valve means and said switching valve means for both operable states of said switching valve means.

* * * * *